United States Patent [19]

Sammon

[11] Patent Number: 5,077,772

[45] Date of Patent: Dec. 31, 1991

[54] RAPID WARM-UP X-RAY TUBE FILAMENT POWER SUPPLY

[75] Inventor: Robert J. Sammon, Seven Hills, Ohio

[73] Assignee: Picker International, Inc., Highland Hts., Ohio

[21] Appl. No.: 549,401

[22] Filed: Jul. 5, 1990

[51] Int. Cl.[5] ..... H05G 1/32

[52] U.S. Cl ..... 378/109; 378/110; 378/101; 378/111

[58] Field of Search ..... 323/246, 275, 285; 378/109, 110, 83, 118, 112, 117, 113

[56] References Cited

U.S. PATENT DOCUMENTS

| | | | |
|---|---|---|---|
| 3,414,803 | 12/1968 | Glasgow et al. | 323/275 |
| 4,363,971 | 12/1982 | Ochmann | 378/110 |
| 4,366,575 | 12/1982 | Bax | 378/110 |
| 4,775,992 | 10/1988 | Resnick et al. | 378/110 |
| 4,809,311 | 2/1989 | Arai et al. | 378/110 |
| 4,930,145 | 5/1990 | Sherwin et al. | 378/109 |
| 4,930,146 | 5/1990 | Flakas et al. | 378/109 |
| 4,933,625 | 6/1990 | Hayakawa | 323/275 |

*Primary Examiner*—Edward P. Westin
*Assistant Examiner*—Kim-Kwok Chu
*Attorney, Agent, or Firm*—Fay, Sharpe, Beall, Fagan, Minnich & McKee

[57] ABSTRACT

A power supply (C) for an x-ray tube filament (10) selectively functions either as a constant voltage source (12) or a constant current source (14). A control circuit (A) includes a voltage controller (56) for enabling the power supply to operate as the constant voltage source in a first time period $t_1$ to $t_2$ during which filament temperature (40) is increasing toward a preselected filament operating temperature (42). Once the filament temperature has substantially reached its operating temperature at a time $t_2$, a timer (52) enables a current control (84) which causes the power supply to supply a constant current across the filament.

10 Claims, 2 Drawing Sheets

RAPID WARM-UP X-RAY TUBE FILAMENT POWER SUPPLY

BACKGROUND OF THE INVENTION

The present invention relates to power supplies. It finds particular application in conjunction with power supplies for x-ray tubes and will be described with particular reference thereto.

The current through the filament of an x-ray tube is one of the parameters that is controlled during an x-ray exposure. Most commonly, the filament is connected in series with a constant current supply. A current limiting or controlling device is placed in series between the constant current source and filament for controlling the amount of current flowing through the filament. The amount of current controls the amount of energy put into the filament, hence its temperature. The temperature affects the rate at which electrons are boiled off, hence the tube current or electron flow between the cathode and anode. If the x-ray tube were operated while the filament is overheated, the patient would be over irradiated and the anode could be damaged.

Commonly, the filament is only brought up to temperature for an exposure and is at a reduced temperature between exposures. One of the problems with a constant current source is that it brings the filament up to the selected operating temperature relatively gradually.

One solution for bringing the filament up to its operating temperature is described in U.S. Pat. No. 4,775,992 to Resnick and Dupuis. To bring the filament up to temperature more quickly, a current boost is applied when the current to the filament is first turned on. That is, instead of supplying the normal operating current to the filament, a higher current is provided for a preselected short duration. Commonly, a current limiting device is disposed between the current source and the filament to prevent the filament from being overdriven. That is, the current limiting device keeps the filament from receiving a current that would heat the filament to a temperature at which a tube current is produced that will heat damage the anode. If such a current boost pulse were applied after the filament were already up to temperature, the filament would become overheated and the resultant tube current could thermally damage the anode. The current limiting device is provided in the circuit to prevent such thermal damage.

To prevent the current limiting device from blocking the boost current, the current limiting device is deactivated during the current boost pulse. One of the drawbacks of this technique is that the current boost or overshoot must be calculated accurately. If the current boost pulse is too high or too long, the filament overheats. If the filament is still hot from the preceding exposure, the filament will overheat. If the pulse is too short or too low, only a minimal increase in the filament heating rate is achieved. Moreover, if the current limiting circuit fails to be reactivated after the current boost is over, the filament is not protected against an overcurrent.

In some x-ray tube power supplies, a voltage source rather than a current source drives the filament. With a voltage source, the power delivered to the filament is proportional to the $V^2/R$, where V is the voltage and R is the filament resistance. Because the filament resistance is low, when the filament is cool and increases as the filament becomes warmer, the actual current flowing through the filament from a constant voltage source is higher initially and drops off towards the steady state operating current as the filament warms. This provides a built-in protection against overheating a filament still hot from the preceding exposure. Although a voltage source brings the filament up to temperature more quickly. It is relatively difficult to control. Typically, the x-ray tube current is relatively high and its resistance relatively low. Moreover, the same current flows through relatively long power supply cables between the power supply and the x-ray tube. The resistance of the cables tends to exceed the resistance of the filament. Because the actual current supply is controlled by the $V^2/R$ relationship in which R is the sum of these resistances, the filament current control accuracy is much worse than with a constant current source.

In accordance with the present invention, there is provided a power supply which has both the filament warm-up advantages of a constant voltage source and the filament current control advantages of a constant current source.

SUMMARY OF THE INVENTION

In accordance with one aspect of the present invention, a power supply is provided which functions as a constant voltage source during a pre-exposure time as an x-ray filament is brought up to temperature and functions as a current source during the exposure.

In accordance with another more limited aspect of the present invention, a switching means is provided for switching the power supply between its constant voltage source and constant current source operating characteristics in accordance with preparation for or the taking of an x-ray exposure.

In accordance with a more limited aspect of the present invention, the voltage across the filament is monitored as a filament feed back voltage and the current through the filament is monitored as a feedback current. A constant current source is controlled in accordance with the fed back filament voltage while the filament is warming up and controlled in accordance with the feed back filament current at least during an x-ray exposure.

One advantage of the present invention is that it brings an x-ray tube filament up to temperature quickly.

Another advantage of the present invention is that it controls x-ray tube filament current accurately.

Yet another advantage of the present invention is that it reliably protects the x-ray tube anodes from excessive tube currents caused by overheated filaments.

Still further advantages of the present invention will become apparent to those of ordinary skill in the art upon reading and understanding the following detailed description.

BRIEF DESCRIPTION OF THE DRAWINGS

The invention may take form in various components and arrangements of components and in various steps and arrangements of steps. The drawings are only for purposes of illustrating the preferred embodiment and are not to be construed as limiting the invention.

DETAILED DESCRIPTION OF THE PREFERRED EMBODIMENTS

Figure 1:
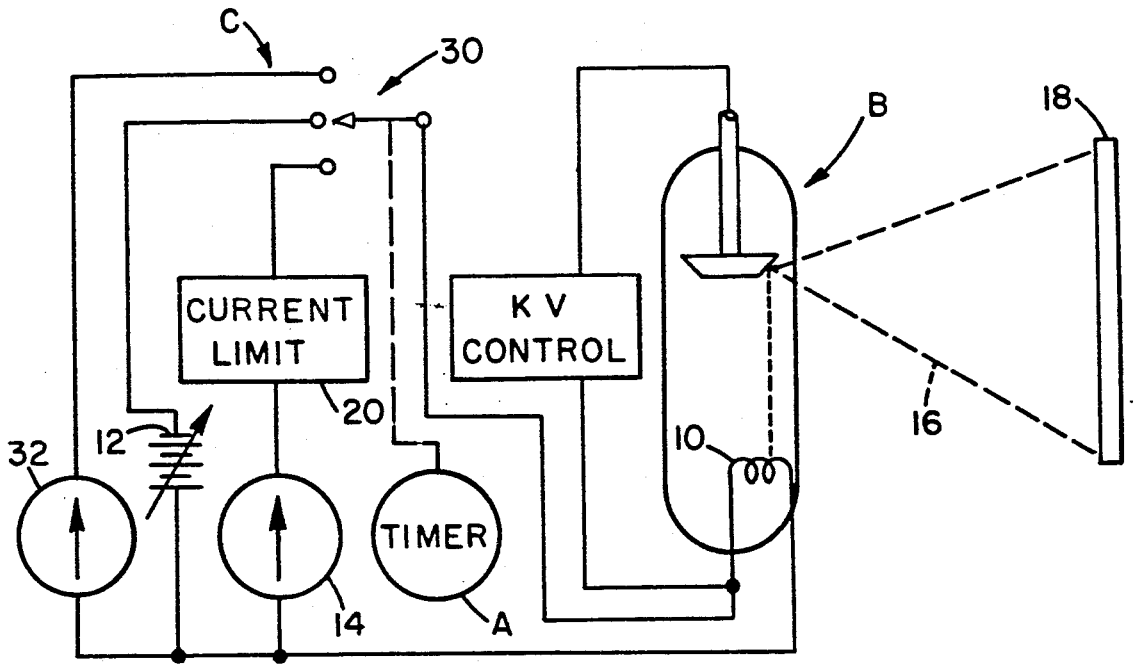
FIG. 1 is a diagrammatic illustration of an x-ray filament control circuit in accordance with the present invention.

With reference to FIG. 1, a control means A such as a timer selectively controls when (i) a cathode filament 10, an x-ray tube B is held at a low stand-by current, (ii) when the filament is being heated, and (iii) the filament is being held at a selected operating temperature which produces a selected current between the cathode filament and an anode of the x-ray tube. The control means A controls a power supply C connected in series with the filament B such that the power supply acts as a constant voltage source 12 when the filament is being warmed or brought up to temperature and as a constant current source 14 when the x-ray tube B is projecting a beam 16 of radiation across a patient receiving region to an x-ray sensitive medium 18. An active current limiting means 20 limits the current flow through the x-ray tube filament.

Figure 2:
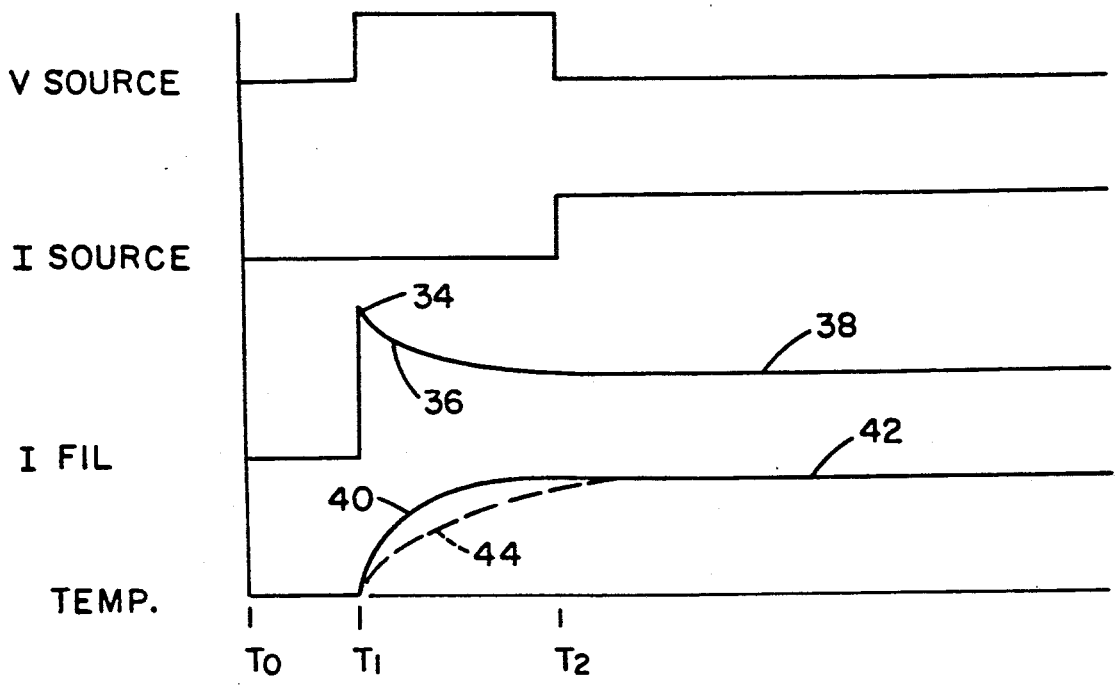
FIG. 2 is a diagrammatic illustration of the operation of the control circuit of FIG. 1 and the resultant effect on x-ray tube filament temperature, hence tube current.

With reference to FIG. 2, the control means A connects a switch means 30 to a low current stand-by power supply 32 when the x-ray tube is in stand-by, denoted in FIG. 2 as times $t_0$ to $t_1$. During an initial pre-exposure period between $t_1$ and $t_2$, the switch means 30 is connected with the constant voltage source 12. The current through the filament 10 is proportional to $V_2/R$, where V is the voltage of the constant voltage source 12 and R is the resistance through the filament. The resistance of the filament varies With temperature. It has a relatively low resistance when cold and a higher resistance when warm. This causes the current through the filament to be a maximum 34 at time $t_1$ decaying generally exponentially 36 toward a steady state operating current 38. In this manner, a current boost is caused following time $t_1$.

It is to be appreciated that if the x-ray tube has been operated recently and the filament is still relatively warm, the initial voltage spike at 34 is lower. In this manner, the size of the current boost is self regulating in accordance with filament temperature. This prevents the filament from being driven beyond the selected operating temperature regardless whether the filament is warm or cold. The initial current boost 34 causes the temperature to rise relatively rapidly 40 towards a selected operating temperature 42 relative to a slower heating rate 44 of a constant current source.

At time $t_2$ when the filament current and temperature have substantially reached their steady state operating conditions, the control means A causes the switching means 30 to connect the constant current source 14 in series with the filament. The control means A may include a filament current sensor, a timer, or the like. The constant current source produces a constant current of the magnitude of the steady state current 38. By holding the current substantially constant, the temperature of the filament is held substantially constant at the selected operating temperature 42. Of course, the control means A may include an appropriate control to bring the filament to any one of a plurality of selected operating temperatures, such as by switching in one of a plurality of constant current sources or adjusting the level of the constant current source. This enables the x-ray tube to be operated at a selectable tube current (mA).

Figure 3:
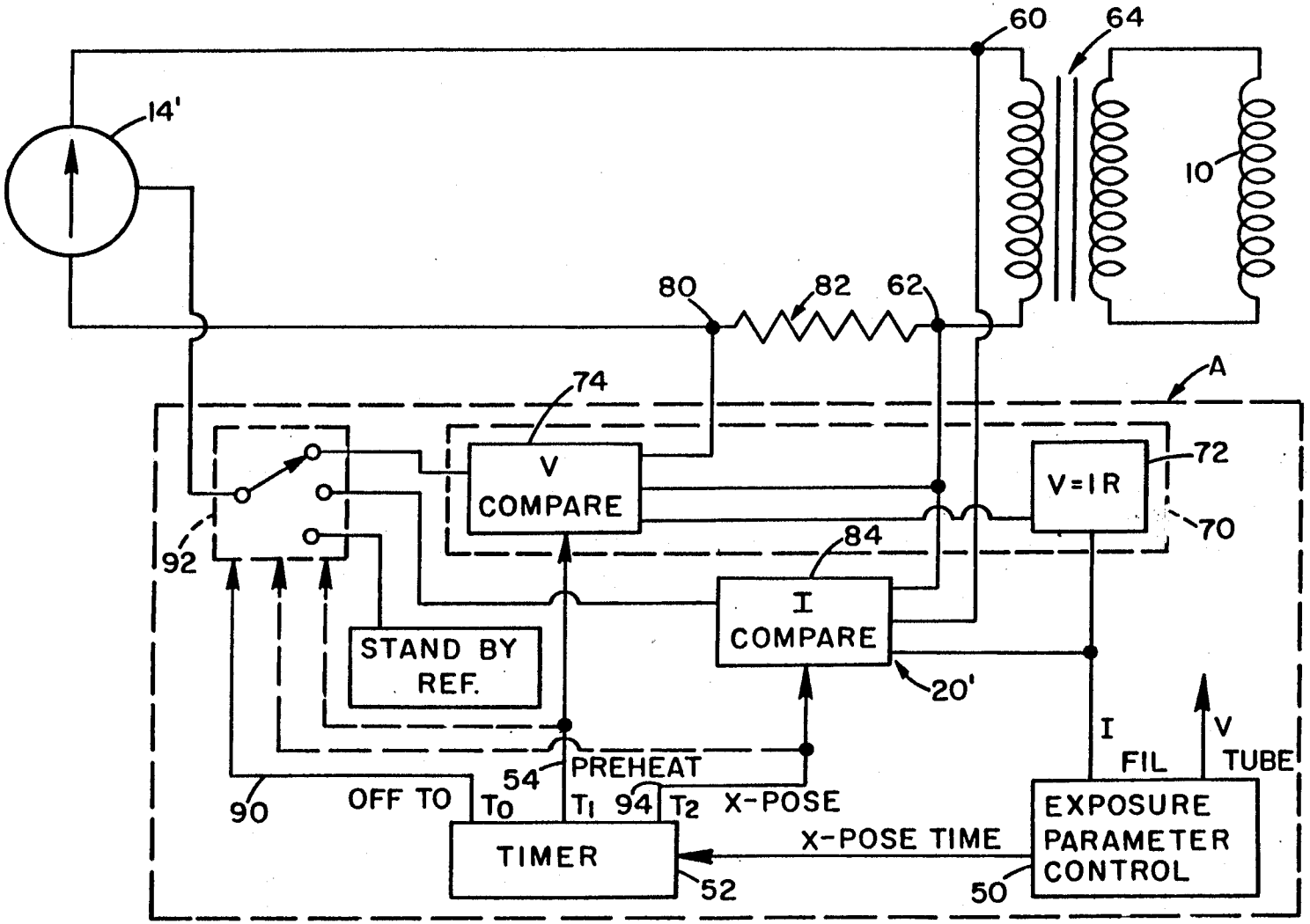
FIG. 3 is a more detailed x-ray tube filament control circuit in accordance with the present invention.

With reference to FIG. 3, the control means A includes an operator pane) 50 on which the operator selects the tube current or mA, exposure duration, and Operating voltage or kV fc. the x-ray tube, and the like. An appropriate enable pulse is sent to a timer 52 such that at time $t_1$, an enable pulse is provided on a pre-exposure initiate output 54. The pre-exposure output causes an adjustable constant current source 14' to function as an effective constant voltage source.

A Voltage tap 60 and a common tap 62 measure a voltage across the filament 10. More specifically, the voltage is measured across a transformer 64 which is connected across the filament, thus measuring the filament voltage indirectly. A voltage control means 70 selectively adjusts the current level of the constant current source 14' such that the voltage across the filament is held constant. The constant voltage control means 70 in the illustrated embodiment includes a current to voltage converting means 72 which converts the filament current that corresponds to the selected tube current at the selected tube voltage to a corresponding selected filament voltage. A comparing means 74 compares the monitored voltage with the selected voltage from the voltage converting means 72 and produces an output signal in accordance with the difference therebetween. In this manner, the level of the constant current generated by the constant current source 14' is controlled such that the filament voltage is held constant, i.e. functions as an effective constant voltage source.

A current sensing tap 80 is connected on the opposite side of a resistor 82 that is in series with the current source 14' and effectively in series with the filament 10. The voltage across the resistor 82 is proportional to the current through the filament 10, hence acts as a filament current feedback signal. A current control means 20' controls the constant current source 14' to maintain the current substantially at the selected filament current. Of course, if the transformer 64 has an other than one to one winding pattern, the current source current would be maintained at a current which is the same ratio relative to the filament current as the turns ratio of the transformer 64. The current limiting means 20' in the illustrated embodiment includes a comparing means 84 which compares the selected filament current, or a multiple thereof as determined by the turns ratio of the transformer and the magnitude of the resistor 82, with the sensed filament current and controls the constant current source 14' in accordance with the difference therebetween.

The timing means 52 enables the constant voltage supply 70 to control the constant current source 14' between times $t_1$ and $t_2$ and causes the current control means 20' to control the constant current source 12' after time $t_2$. In the illustrated embodiment, the timer 52 includes an output 90 which causes a switching means 92 to connect the constant current source 14' with a stand-by control value such that a low current is supplied to the filament when no exposure is imminent. At time $t_1$, the timer provides an output on output 54 which causes the switching means 92 to connect the filament voltage comparing means 74 with the constant current source in a controlling relationship. When the steady state filament operating temperature has been attained, e.g. at time $t_2$, the timing means 52 provides an output on output 94 which causes the switching means 92 to connect the filament current comparing means 84 to the constant current source in a controlling relationship thereto. Alternately, the timing means might use the output 54 to enable comparing means 74 and the output on line 94 to enable the filament current comparing means 84. Of course, the control means may measure the filament temperature or current directly rather than allocating an estimated time.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the prefered embodiment, the invention is now claimed to be:

1. An x-ray tube filament current supply circuit comprising:

a power supply which selectively functions as (i) a constant current source and (ii) a constant voltage source;

a control means for selectively causing the power supply to function as a constant voltage source before an x-ray tube operating voltage is applied across the filament and an anode as the x-ray filament is being brought up to a selected operating temperature and for causing the power supply to function as the constant current source after the x-ray tube filament is substantially at the operating temperature after which the x-ray tube operating voltage is applied.

2. The circuit as set forth in claim 1 wherein the control means includes:

a filament voltage sensing means for sensing a voltage across the filament and for producing a sensed filament voltage signal indicative thereof;

a power supply controlling means for controlling the power supply such that the sensed voltage is maintained substantially at a preselected voltage..

3. The circuit as set forth in claim 2 wherein the control means further includes:

a filament current sensing means for sensing current flow through the filament and producing a sensed filament current signal indicative thereof;

a means for comparing the sensed filament current signal with a selected filament current and controlling the power supply such that the filament current is held substantially at the selected filament current.

4. The apparatus as set forth in claim 1 wherein the control means includes:

a filament current sensing means for sensing current flow through the filament and producing a sensed filament current signal indicative thereof;

a means for comparing the sensed filament current signal with a selected filament current and controlling the power supply such that the filament current is held substantially at the selected filament current.

5. A power supply circuit for an x-ray tube filament, the power supply circuit comprising:

a constant voltage source means for selectively providing a constant voltage across the x-ray tube filament;

a constant current source means for selectively supplying a constant current through the x-ray tube filament;

a current limiting means for limiting the current supplied by the constant current source means to the filament;

a switching means for switching (i) the constant voltage source means across the filament as the filament is being heated to its operating temperature and (ii) the constant current source means into electrical communication with the filament to supply the constant current through the filament when the filament has reached its operating temperature.

6. The circuit as set forth in claim 5 further including a timing means for controlling the switching means such that the constant voltage source is switched into communication with the x-ray tube filament for a first preselected duration and for connecting the constant current source with the x-ray tube filament for a second preselected duration following the first preselected duration.

7. The circuit as set forth in claim 5 further including:

a filament voltage sensing means for sensing a voltage across the filament and for producing a sensed filament voltage signal indicative thereof;

a power supply controlling means for controlling the power supply such that the sensed voltage is maintained substantially at a preselected voltage.

8. The circuit as set forth in claim 5 wherein the control means includes:

a filament current sensing means for sensing current flow through the filament and producing a sensed filament current signal indicative thereof;

a means for comparing the sensed filament current signal with a selected filament current and controlling the power supply such that the filament current is held substantially at the selected filament current.

9. The circuit as set forth in claim 5 wherein the power supply means includes a constant current source that has a selectively adjustable constant current level and further including:

a filament voltage monitoring means for monitoring voltage across the filament and controlling the constant current source in accordance therewith;

a filament current monitoring means for monitoring a current through the filament and selectively controlling the constant current source in accordance therewith; and, wherein the switching means selectively controls which of the filament voltage and current monitoring means is connected with the adjustable constant current source.

10. A method of controlling an x-ray tube filament current, the method comprising:

supplying a constant voltage across the x-ray tube filament as the filament is being brought up toward a selected operating temperature; and, once the x-ray tube has substantially reached the operating temperature, providing a constant current through the filament to maintain the filament substantially at the selected temperature.

* * * * *